United States Patent [19]

Mitsubori et al.

[11] Patent Number: 5,028,208

[45] Date of Patent: Jul. 2, 1991

[54] NOZZLE BLADE ANGLE ADJUSTMENT DEVICE FOR VARIABLE GEOMETRY TURBOCHARGER

[75] Inventors: Ken Mitsubori; Yukio Takahashi; Hiromu Furukawa, all of Yokohama, Japan

[73] Assignee: Ishikawajima-Harima Jukogyo Kabushiki Kaisha, Tokyo, Japan

[21] Appl. No.: 458,163

[22] Filed: Dec. 28, 1989

[30] Foreign Application Priority Data

Jan. 10, 1989 [JP] Japan ..... 1-3043
Jan. 10, 1989 [JP] Japan ..... 1-3044

[51] Int. Cl.[5] ..... F01B 25/02

[52] U.S. Cl. ..... 415/150; 415/163; 415/164; 415/166; 415/178; 417/407

[58] Field of Search ..... 415/148, 150, 151, 155, 415/159, 160, 163, 164, 165, 166, 110, 111, 177, 178; 417/405, 406, 407, 408, 409

[56] References Cited

U.S. PATENT DOCUMENTS

| | | | |
|---|---|---|---|
| 922,216 | 5/1909 | Uhl | 415/164 |
| 1,728,719 | 9/1929 | Biggs | 415/164 |
| 3,069,070 | 12/1962 | Macaluso et al. | 415/148 |
| 3,101,926 | 8/1963 | Weber | 415/110 |
| 4,101,241 | 7/1978 | Kasuya | 415/407 |
| 4,107,927 | 8/1978 | Gordon, Jr. et al. | 415/407 |
| 4,678,397 | 7/1987 | Kamatsu et al. | 415/151 |
| 4,685,869 | 8/1987 | Sasaki | 415/164 |
| 4,741,666 | 5/1988 | Shimizu et al. | 415/166 |
| 4,780,054 | 10/1988 | Yano et al. | 415/164 |
| 4,867,637 | 9/1989 | Hayama | 415/148 |
| 4,880,351 | 11/1989 | Inoue et al. | 415/164 |

FOREIGN PATENT DOCUMENTS

| | | | |
|---|---|---|---|
| 0093902 | 5/1983 | Japan | 415/166 |
| 0178827 | 10/1983 | Japan | 415/166 |
| 0178828 | 10/1983 | Japan | 415/166 |
| 0153403 | 8/1985 | Japan | 415/166 |
| 0198306 | 10/1985 | Japan | 415/166 |

*Primary Examiner*—John T. Kwon
*Assistant Examiner*—Christopher M. Veidier

[57] ABSTRACT

Nozzle shafts and a nozzle drive mechanism are disposed on the side of a bearing casing and a compressor whose temperatures are lower than that of a turbine, and elements slidable in the radial direction of the turbine wheel are eliminated from the nozzle drive mechanism so that any adverse effects due to oxidization at high temperatures and slide wear can be eliminated. Thus durability and reliability of the device can be improved.

4 Claims, 7 Drawing Sheets

NOZZLE BLADE ANGLE ADJUSTMENT DEVICE FOR VARIABLE GEOMETRY TURBOCHARGER

BACKGROUND OF THE INVENTION

The present invention relates to a nozzle blade angle adjustment device for a variable geometry turbocharger.

In order to improve heat efficiency of various prime movers, turbochargers used to date are of the type in which a turbine is rotated by exhaust gases from a prime mover to drive a compressor which in turn compresses and charges air into the prime mover.

With the turbocharger of this type, the flow rate of exhaust gases used as a power source varies in response to variation in load on the prime mover. Therefore, such a variable geometry turbocharger has been devised and demostrated as described in U.S. Pat. No. 4,741,666 which has a device for adjusting, in response to a load on a prime mover, angles of nozzle blades for guiding exhaust gases to a turbine wheel.

Such a nozzle blade angle adjustable device will be explained in more detail with reference to FIGS. 1 and 2.

A turbocharger comprises a turbine 1 and a compressor 2 connected through a bearing casing 3 to the turbine 1.

The turbine 1 includes a casing 4 and a gas outlet cover 5 which clamp together a shroud 6 which in turn rotatably supports each nozzle shaft 7 through a bearing 8. The shaft 7 has a nozzle blade 9 at its one end adjacent to the casing 4 and has a nozzle link 10 at its other end adjacent to the cover 5.

The cover 5 and shroud 6 define together a space 12 which is in the form of a doughnut to surround a gas outlet 11 and which accommodates a rotatable nozzle drive ring 13 in addition to the nozzle links 10. The ring 13 has a pins 14 and slide joints 15 both extending from the ring 13. The joint 15 is radially slidably fitted into a slide groove 16 defined at one end of the corresponding link 10. The ring 13 has also a pin 17 and a slide joint 18 both extending from the ring 13. The joint 18 is radially slidably fitted into a guide groove 20 at one end of a drive link 19. The drive link 19 is securely attached at its rear end to one end of a drive shaft 22 which passes through the cover 5 through a bearing 21. The other end of the shaft 22 is connected to a drive lever 23. Reference mumeral 24 designates a turbine wheel; 25, a compressor wheel; 26, a turbine shaft; 27, a water jacket; 28, and oil supply opening; 29, an oil discharge opening; and 30, guides for guidance of the rotating ring 13.

When the drive lever 23 is driven by an external power source, the nozzle ring 13 is caused to rotate through the shaft 22 and the link 19. In response to the degree of rotation of the ring 13, the angles of all of the nozzle blades 9 are simultaneously varied through the nozzle links 10.

With the conventional nozzle blade angle adjustment device just described above, the device itself rises in temperature in excess of 500° C. during operation and is in a turbine which is too high in temperature to lubricate (since any lubricating oil supplied would be carbonized due to the high temperature). As a result, the following problems arise.

Slide elements slidable in the radial direction of the ring 13 and thus of the turbine wheel 24 such as the slide joints 15 and 18 and the slide guide grooves 16 and 20 are adversely affected by oxidation at high temperature as well as wear caused by slide motion. As a result, the surface of the slide element is covered with fragile, oxidized layer due to oxidization at high temperature and said oxidized layer is readily worn out due to the slide contact. This is repeated many times, resulting in breakdown of the slide elements. Consequently the reliability of the device is not satisfactorily ensured because of its low durabililty.

In view of the above, a primary object of the present invention is to provide a nozzle blade angle adjustment device for a variable geometry turbocharger which can be installed at low temperature portions and can be cooled to reduce adverse effects due to oxidization at high temperatures and which has no slide elements slidable in the radial direction of a turbine wheel and liable to receive slide wear, thereby enhancing the durability and realiability of the device.

BRIEF DESCRIPTION OF THE DRAWINGS

The same reference numerals are used to designate similar parts throughout the figures.

DETAILED DESCRIPTION OF THE PREFERRED EMBODIMENTS

Figure 1:
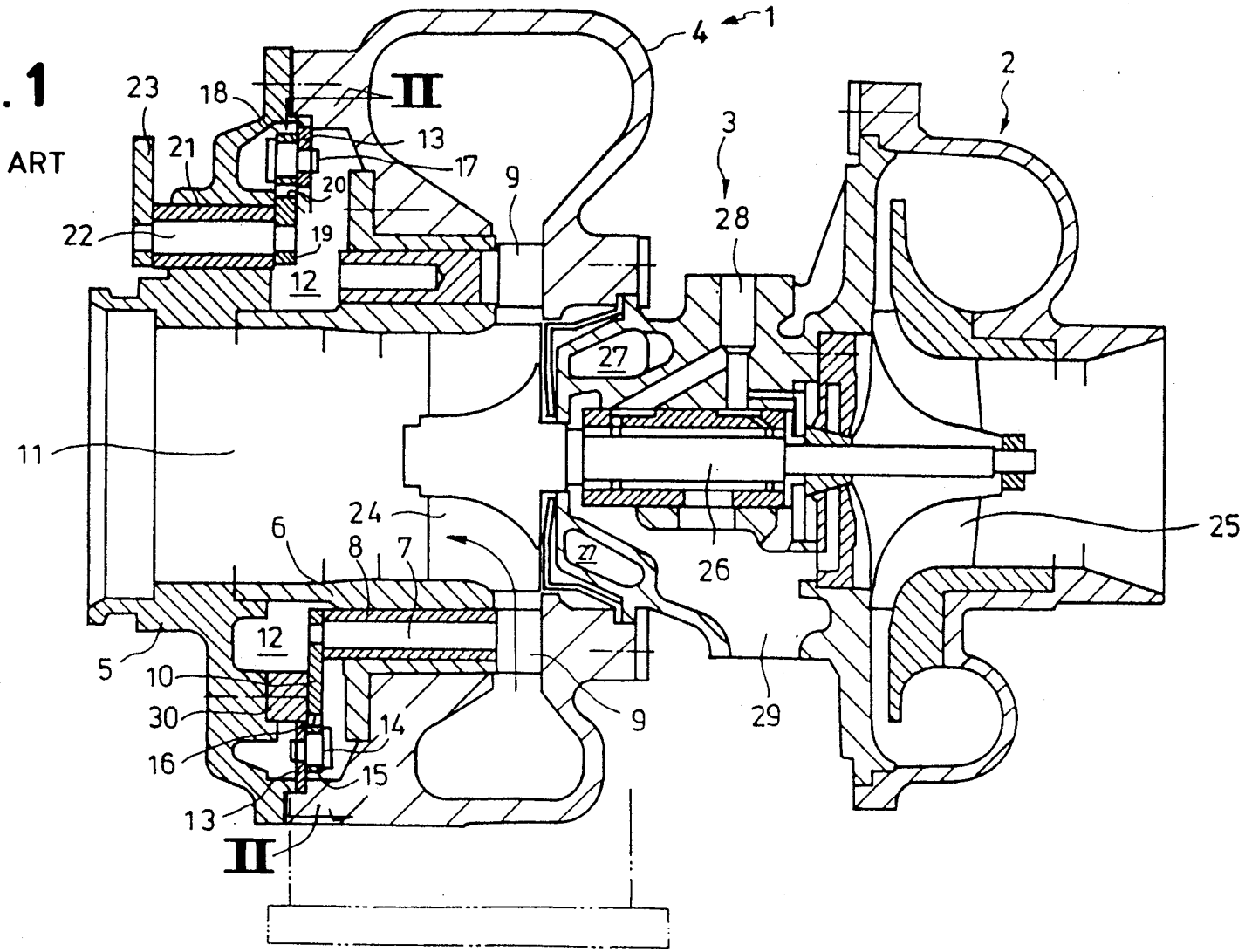
Fig. 1 PRIOR ART
FIG. 1 is a side sectional view of a conventional nozzle blade angle adjustment device for a variable geometry turbocharger.
Figure 2:
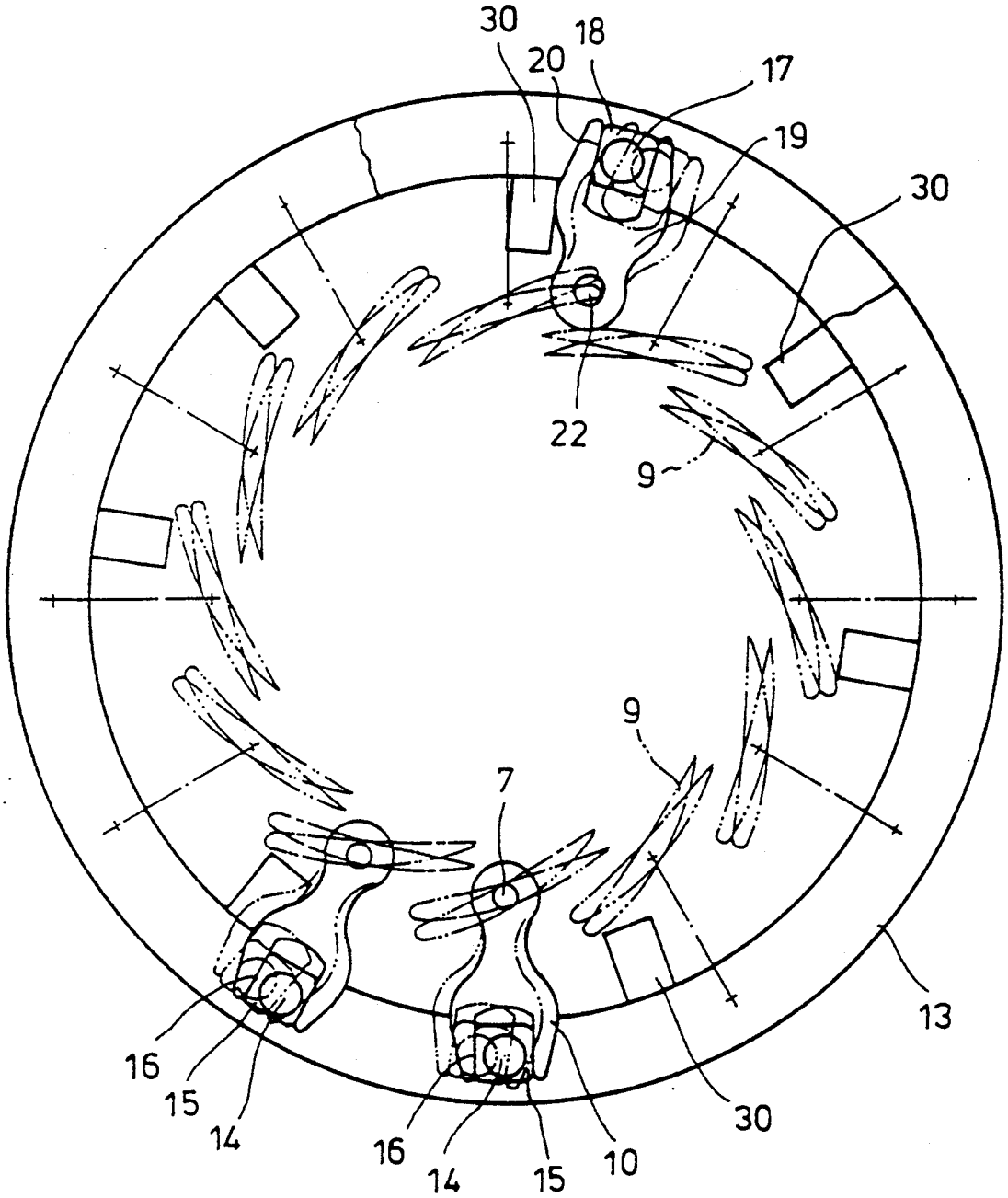
Fig. 2 PRIOR ART
FIG. 2 is a sectional view taken along the line II—II of FIG. 1.
Figure 3:
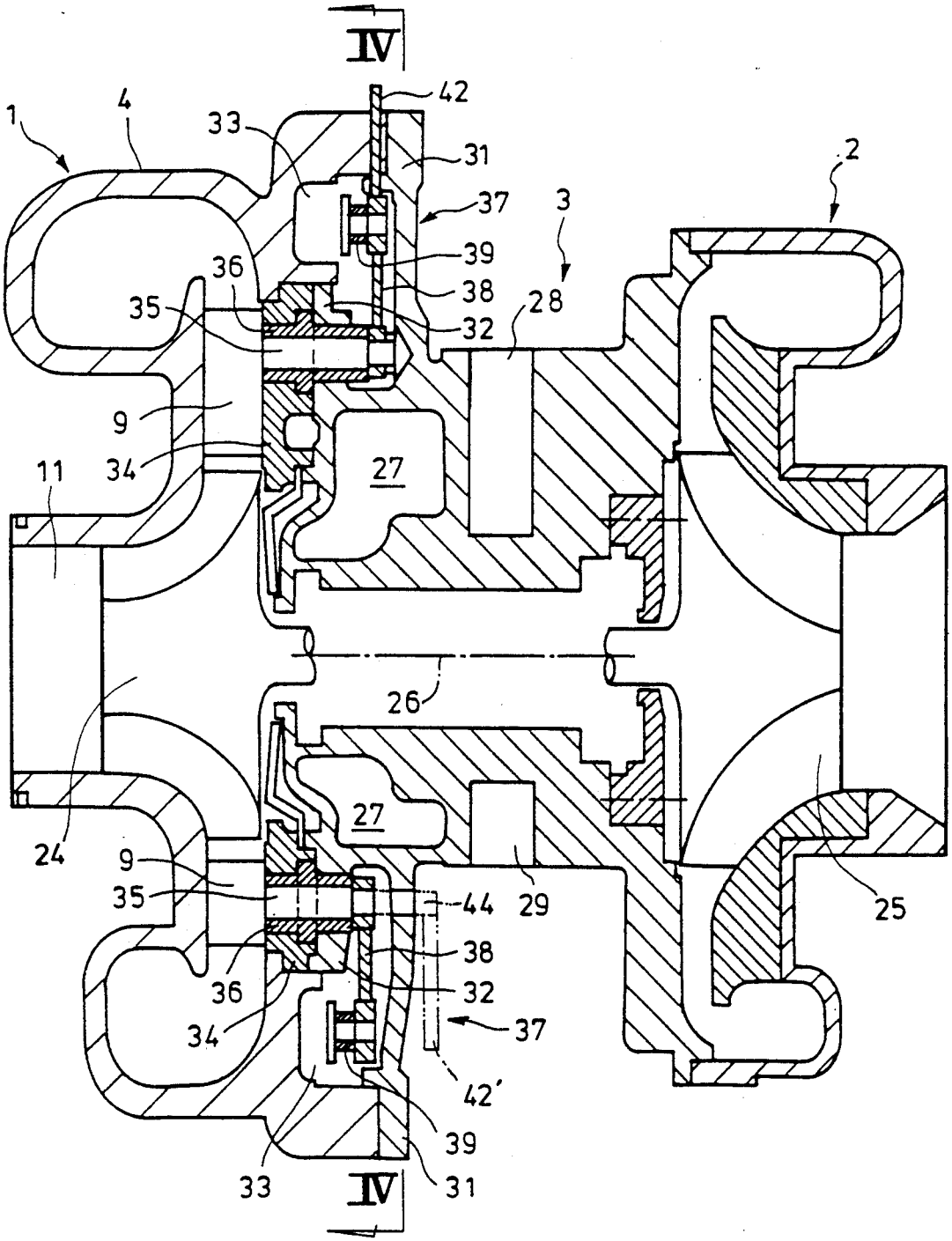
FIG. 3 is a longitudinal sectional view of a first preferred embodiment of the present invention.

First referring to FIG. 3, large and small flanges 31 and 32 are formed around the outer periphery of the water jacket 27 of the bearing casing 3 in the order of remoteness from the turbine shaft 26. The flange 31 defines with the casing 4 a doughnut-shaped space 33 surrounding the water jacket 27. The flange 32 has a ring-shaped heat shielding plate 34 which is securely attached to the surface of the flange 32 adjacent to the turbine wheel 24. The shielding plate 34 and the flanges 32 rotatably support each nozzle shaft 35 extending in the axial direction of the tubine shaft 26 through a bearing 36. The nozzle shaft 35 has a nozzle blade 9 securely attached to one of the shaft 35 adjacent to the turbine wheel 24. The other end of the nozzle shaft 35 adjacent to the space 33 is connected to a nozzle blade drive mechanism 37.

Figure 4:
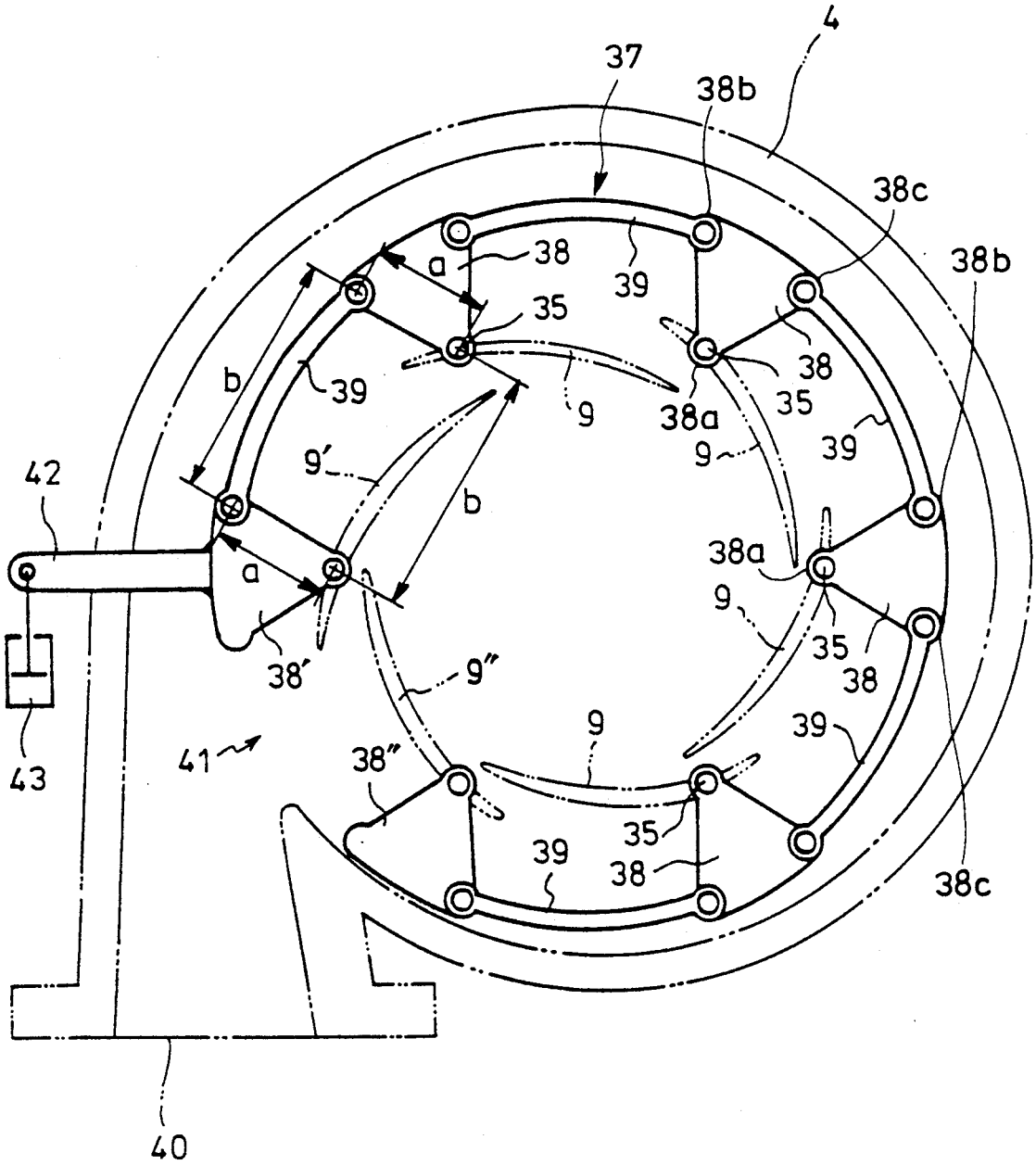
FIG. 4 is a sectional view taken along the line IV—IV of FIG. 3.

Referring next to FIG. 4, the nozzle blade drive mechanism 37 will be described in more detail. A link plate 38 in the form of for example an equilateral triangle or letter T or Y with vertexes 38*a*, 38*b* and 38*c* and with distances between the vertexes 38*a* and 38*b* and between 38*a* and 38*c* labeled a is securely attached at its first or top vertex 38*a* to the other end of the shaft 35. The third vertex 38*c* of one link plate 38 is pivotably connected to the second vertex 38*b* of its adjacent downstream link plate 38 through a connecting plate 39 which has length equal to the distance b between the top vertexes 38*a* of these link plates 38 or between the adjacent nozzle shafts 35. The link plates 38 are sequentially interconnected from the upstream side to the downstream side in this manner. Thus a plurality of parallelogram linkages with the vertexes 38*a*, 38*a*, 38*c* and 38*b* are constructed. Therefore when one link plate 38 is swung, the angle of the nozzle blade 9 securely attached to the corresponding shaft 35 is varied and this motion is transmitted through the connecting plates 39 to the downstream link plates 38 in sequence, whereby the angles of all the nozzles blades 9 are varied simultaneously.

The second vertex 38*b* of a link plate 38' securely attached to for instance an uppermost upstream nozzle blade 9' in the flow of the exhaust gases adjacent to a turbine inlet 40 is not connected to the third vertex 38*c* of the link plate 38'' attached to a downstream nozzle blade 9'' to thereby define an unconnected section 41 for absorbing any adverse effects due to tolerances of sizes and thermal expansions of the plates 38 and 39.

A drive lever 42 which extends through and beyond the wall of the turbine casing 4 is securely attached to a link plate 38' associated with the uppermost upstream nozzle 9'. A drive source 43 such as an air cylinder is connected to an outer end of the lever 42 to drive the latter for swinging motor of the link plates 38', 38 and 38''.

Aletenatively, as indicated by the imaginary line in FIG. 3, a drive lever 42' may be securely attached to a extension 44 of the nozzle shaft 35.

Next the mode of operation of the first preferred embodiment with the above-described construction will be described in detail.

When the drive lever 42 is swung by actuation of the drive device 43, the link plate 38' securely attached to the levesr 42 is swung to vary the angle of the nozzle 9' through the nozzle shaft 35.

Simultaneously, the swing motion of the link plate 38' is transmitted through the connecting plates 39 to the downstream link plates 38 and 38'' sequentially so that the link plates 38 and 38'' are swung to vary the angles of the nozzles 9 and 9''.

In this manner, the drive lever 42 can adjust the angles of the nozzles 9, 9'and 9'' simultaneously.

The adjacent link plates 38 and the connecting plate 39 therebetween provides a parallelogram linkage so that when the link plate 38 is swung, the connecting plate 39 can displace in the radial direction of the turbine wheel 24. There is no need of designing the connecting plate 39 slidable in the radial direction of the turbine wheel 24 with respect to the link plate 38. The swinging motion is caused only by the use of pin joints at connections of the connecting plates with the link plates so that no slide elements liable to receive adverse effects of the oxidation at high temperatures and wear are provided. Thus the durability and reliability of the device can be remarkably improved.

Furthermore, as described above, the uppermost upsteam link plate 38' and the downmost downstream link plate 38'' are unconnected to define an unconnected section 41 for absorbing tolerances in size of and thermal expansion of the plates 38, 38', 38'' and 39. As a result, it becomes possible to decrease the distance b between the adjacent nozzle shafts 35 so as to increase in number the connecting plates 39, the link plates 38 and the nozzles 9 and so as to ensure their smooth operations.

Because of the unconnected section 41 thus defined, the drive force transmitted from the lever 42 to the link plates 38 become weaker as the distance of each link plate 38 from the lever 42 is increased; however, since the lever 42 is securely attached to the uppermost upstream link plates 38', the nozzle 9' which is most affected by pulsation of the exhaust gases can be driven by the strong force to accomplish reliable angle adjustment.

The nozzle shafts 35, which are supported on the side of the water jacket 27 of the bearing casing 3, can be cooled by the water circulating through the jacket 27 to lower their temperatures. As a result, the heat from the nozzles 9 can be prevented from being transmitted through the nozzle shafts 35 to the nozzle blade drive mechanism 37 so that the temperature rise of the drive mechanism 37 can be avoided.

Therefore breakdown of the nozzle shafts 35 and nozzle blade drive mechanism 37 due to the oxidation at high temperatures and wear can be suppressed to improve the durability and reliability of the device.

Figure 5:
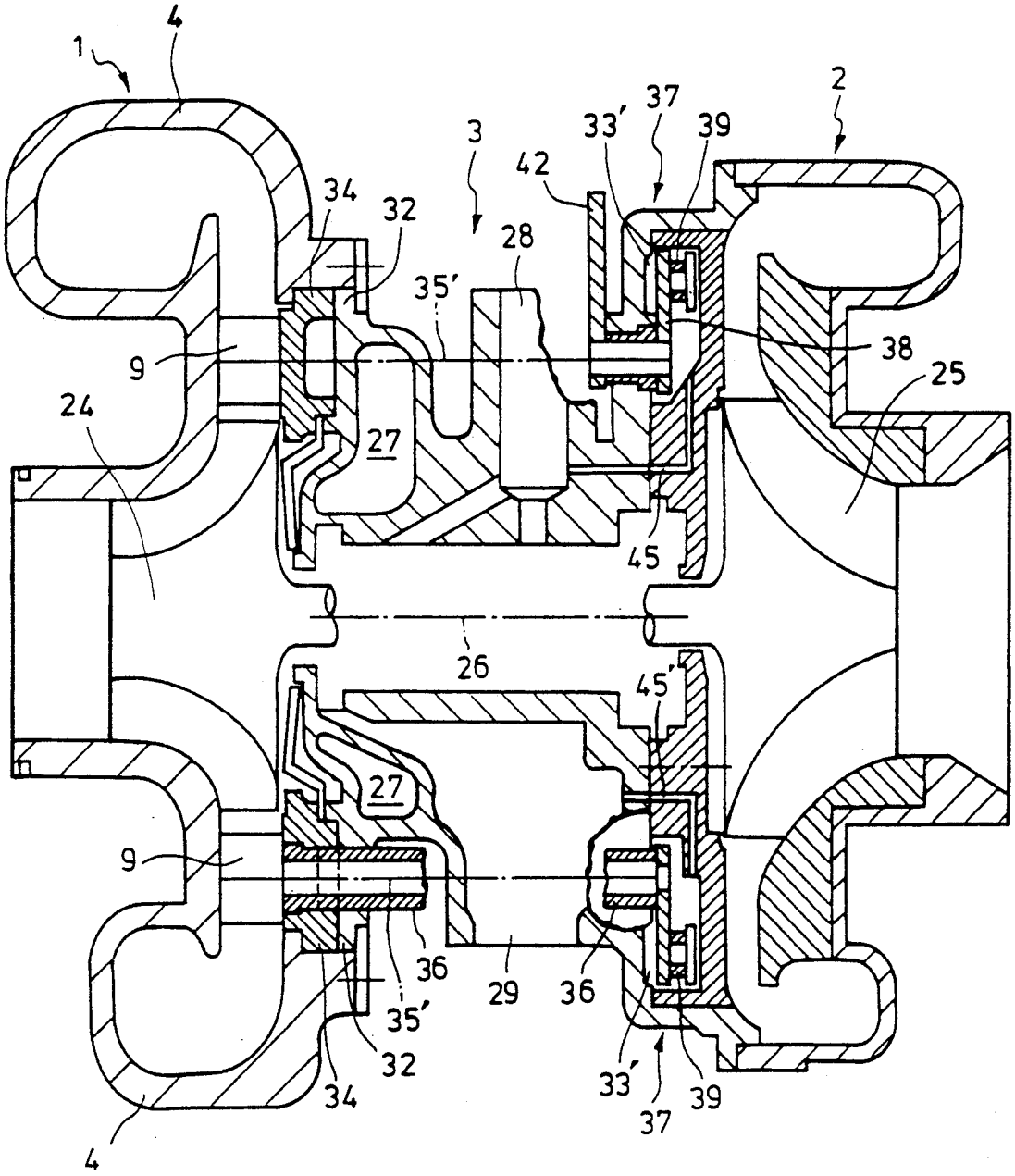
FIG. 5 is a longitudinal view of a second preferred embodiment of the present invention.

A second preferred embodiment of the present invention as shown in FIG. 5 is substantially similar in construction to the first embodiment described above with reference to FIGS. 3 and 4 except that a nozzle shaft 35' extends to the compressor 2 and is connected to the nozzle blade drive mechanism 37 disposed within a doughnut-shaped space 33' defined between the bearing casing 3 and the compressor 2.

The second embodiment can attain the same effects as the first embodiment. The nozzle shaft 35' and the bearing 36 are cooled by the water circulating through the water jacket 27 so that the nozzle shaft 35', which extends to the compressor 2, is less affected by the thermal expansion. Furthermore, the nozzle blade drive mechanism 37 is cooled by the air compressed by the compressor 2 into lower temperature (about 150° C.) as compared with the first embodiment. As a result, the oxidization at high temperature is excess of about 300° C. can be substantially completely eliminated. Lubrication is carried out by providing a supply passage 45 or 45' of the lubricating oil (which may be carbonized at about 200° C.) in communication with the oil supply opening 28 or the oil discharge opening 29 so that the problem of wear can be solved and the durability and reliability can be considerably improved as compared with the first embodiment. (The supply passage 45 provides forced lubrication; and the supply passage 45', mist lubrication.)

Figure 6:
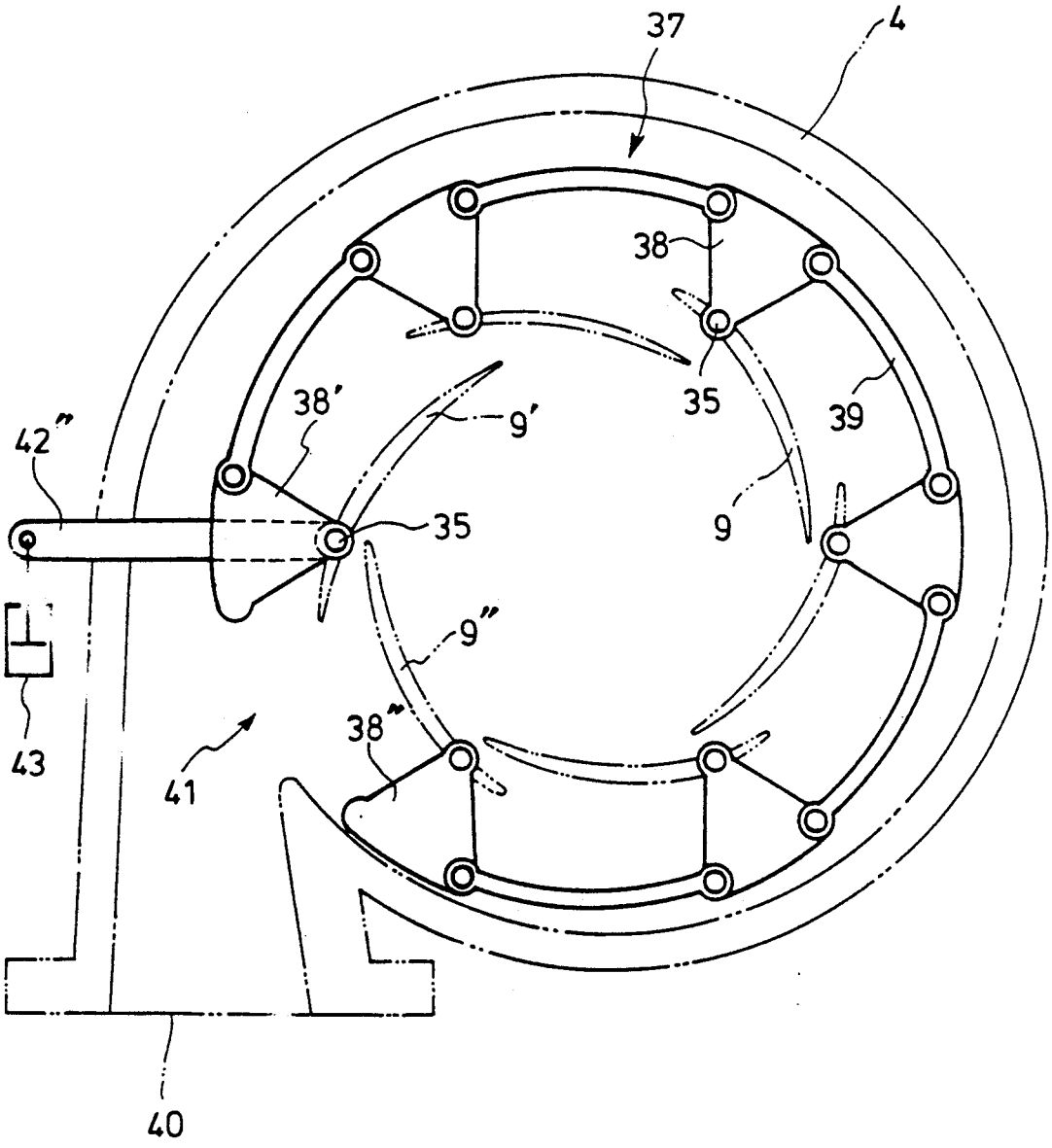
FIG. 6 is a cross sectional view of a third preferred embodiment of the present invention.

A third perferred embodiment shown in FIG. 6 is substantially similar in construction to the first or second preferred embodiment described above with reference to FIGS. 3 or 5 except that the inner end of a drive lever 42'' is directly securely attached to the nozzle shaft 35 of the link plate 38' and the same effects with those attained by the first or second embodiment can be attained.

Figure 7:
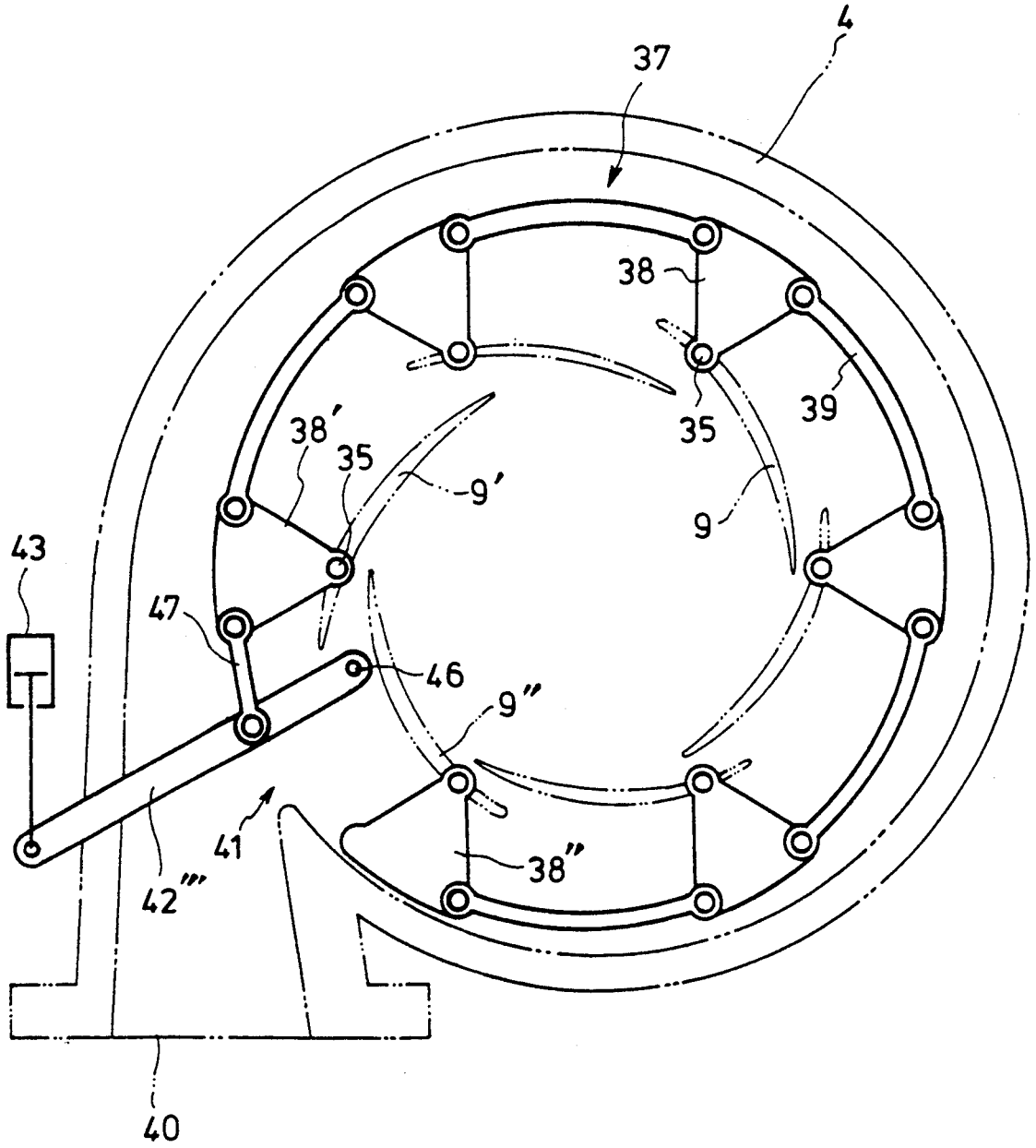
FIG. 7 is a cross sectional view of a fourth preferred embodiment of the present invention.

A fourth embodiment shown in FIG. 7 is substantially similar in construction to the first or second embodiment described above with reference to FIG. 3 or 5. The difference resides in that the inner end of a drive lever 42''' is pivoted with a pivot pin 46 to a tubine casing (not shown) and is connected through a connecting plate 47 to the link plate 38'. The fourth embodiment can also attain the effects substantially similar to those attained by the first or second embodiment.

it is to be understood that the nozzle blade angle adjustment device for variable geometry turbocharger in accordance with the present invention is not limited to the above-described embodiments and that various modifications may be effected without leaving the true spirit of the present invention. For instance, the link and connecting plates may have any suitable shapes, respectively; any suitable way for attaching the drive lever may be used; and the unconnected section may be selected at any suitable position.

As described above, according to the nozzle blade angle adjustment device for variable geometry turbocharger in accordance with the present invention has the following effects, features and advantages:

(1) The nozzle shafts are rotatably supported in the vicinity of the water jacket of the bearing casing and the nozzle blade drive mechanism is disposed on the side of the bearing casing or the compressor so that the heat of the nozzle blades can be prevented from being transmitted to the nozzle blade drive mechanism. As a result, any damages of the nozzle shafts and the nozzle blade drive mechanism due to the oxidation at high temperatures and wear can be avoided to thereby remarkably improve the durability and reliability of the device.

(2) Adjacent link plates connected to the corresponding nozzle shafts are pivotably interconnected by means of a connecting plate. Therefore when the link plates are swung, the connecting plates can be displaced in the radial direction of the turbine wheel. Slide elements slidable in the radial direction of the turbine wheel can be eliminated and respective parts are connected with pin joints so that any damages of the parts due to sliding wear can be prevented and consequently durability and reliability of the device can be improved.

(3) At least one pair of adjacent link plates are unconnected with each other to define an unconnected section so that tolerance in size of and thermal expansion of the link plates and the connecting plates can be absorbed.

(4) The drive lever is associated with the uppermost upstream nozzle blade in the flow of the exhaust gases so that the adjustment of the angles of the nozzle blades can be correctly made without being adversely affected by any pulsation of the exhaust gases.

What is claimed is:

1. A nozzle blade angle adjustment device for a variable geometry turbocharger in which angles of nozzles blades for guiding exhaust gases to a turbine wheel can be adjusted, comprising nozzle shafts, each of said nozzle shafts having one end to which a corresponding nozzle blade is securely attached and being rotatably supported adjacent a water jacket of a bearing casing, and a nozzle blade drive mechanism securely attached to the other ends of the nozzle shafts; and said nozzle blade drive mechanism is disposed in a space defined by said bearing casing and a compressor.

2. The device according to claim 1 further comprising means for supplying lubricating oil to said space.

3. A nozzle blade angle adjustment device for a variable geometry turbocharger comprising a nozzle blade drive mechanism which comprises link plates each securely attached to one end of a corresponding nozzle shaft the other end of said nozzle shaft being securely attached to a corresponding nozzle blade, connecting plates each interconnecting adjacent link plates at points on said adjacent link plates such that a distance between the said plate points on said adjacent link plates becomes equal to a distance between the corresponding nozzle shafts, said points on said adjacent link plates being spaced apart from the corresponding nozzle shafts by a predetermined distance, a drive lever for varying angles of nozzle blades, and an unconnected section being defined by non connecting adjacent link plates.

4. The device according to claim 3 wherein said drive lever is interconnected to an uppermost upstream nozzle in the flow of said exhaust gases.

* * * * *